US010618715B2

(12) United States Patent
Paul

(10) Patent No.: US 10,618,715 B2
(45) Date of Patent: Apr. 14, 2020

(54) PALLET-LIKE UNDERSTRUCTURE FOR TRANSPORT AND STORAGE CONTAINERS FOR LIQUIDS

(71) Applicant: PROTECHNA S.A., Fribourg (CH)

(72) Inventor: Ulrich Paul, Ransbach-Baumbach (DE)

(73) Assignee: PROTECHNA S.A., Fribourg (CH)

( * ) Notice: Subject to any disclaimer, the term of this patent is extended or adjusted under 35 U.S.C. 154(b) by 0 days.

(21) Appl. No.: 15/544,361

(22) PCT Filed: Feb. 2, 2016

(86) PCT No.: PCT/EP2016/052133
§ 371 (c)(1),
(2) Date: Sep. 25, 2017

(87) PCT Pub. No.: WO2016/128248
PCT Pub. Date: Aug. 18, 2016

(65) Prior Publication Data

US 2018/0186539 A1 Jul. 5, 2018

(30) Foreign Application Priority Data

Feb. 11, 2015 (DE) ..... 20 2015 000 994 U

(51) Int. Cl.
*B65D 77/04* (2006.01)
*B65D 19/00* (2006.01)

(52) U.S. Cl.
CPC ..... *B65D 77/0466* (2013.01); *B65D 19/0073* (2013.01); *B65D 2519/00024* (2013.01); *B65D 2519/00273* (2013.01)

(58) Field of Classification Search
CPC .... B65D 19/00; B65D 19/0073; B65D 19/06; B65D 21/02; B65D 25/14; B65D 77/04;
(Continued)

(56) References Cited

U.S. PATENT DOCUMENTS 5,058,747 A * 10/1991 Decroix ..... B65D 77/0466 206/386
5,649,640 A * 7/1997 Hermann ..... B65D 77/0466 220/1.5

(Continued)

FOREIGN PATENT DOCUMENTS

CN 1230935 A 10/1999
CN 1500709 A 6/2004

(Continued)

*Primary Examiner* — Bryon P Gehman
(74) *Attorney, Agent, or Firm* — King & Schickli, PLLC

(57) ABSTRACT

A pallet understructure, in particular for transport and storage containers for liquids, which are equipped with an inner container made of plastic, with a closable filling neck and a draining neck for connecting a tapping armature, the understructure having an outer jacket made of a metal grid or sheet metal, and a bottom for supporting the inner container, corner feet and central feet arranged between the corner feet as well as a bottom cross member, at least the outer jacket and the bottom cross member being attached to at least two central feet, the respective central foot, the outer jacket and the bottom cross member being coupled in a form-fitting fashion with the aid of a screw, wherein the screw is engaged with the bottom cross member in a form-fitting fashion.

14 Claims, 5 Drawing Sheets

(58) Field of Classification Search
CPC .... B65D 77/0466; B65D 77/06; B65D 90/20; B65D 90/22; B65D 2519/00024; B65D 2519/00273; B65D 90/02; B65D 90/04; B65D 90/08; B65D 90/14
USPC ..... 220/9.1–9.4
See application file for complete search history.

(56) References Cited

U.S. PATENT DOCUMENTS

| | | | | |
|---|---|---|---|---|
| 6,719,164 | B2 * | 4/2004 | Maschio | B65D 19/0012 206/386 |
| 7,017,499 | B2 * | 3/2006 | Schutz | B65D 77/0466 108/51.11 |
| 7,878,327 | B2 * | 2/2011 | Cassina | B65D 19/10 206/386 |
| 8,505,721 | B2 * | 8/2013 | Schutz | B65D 77/0466 206/386 |
| 8,567,626 | B2 * | 10/2013 | Schutz | B65D 77/0466 220/1.6 |
| 8,919,562 | B2 * | 12/2014 | Schutz | B65D 19/0073 220/9.4 |
| 9,233,777 | B2 * | 1/2016 | Weyrauch | B65D 77/0466 |
| 9,394,077 | B2 * | 7/2016 | Weyrauch | B65D 77/0466 |
| 9,394,079 | B2 * | 7/2016 | Weyrauch | B65D 77/0466 |
| 2012/0279898 | A1 | 11/2012 | Schutz | |

FOREIGN PATENT DOCUMENTS

| | | | |
|---|---|---|---|
| CN | 1740579 | A | 3/2006 |
| CN | 102442460 | A | 5/2012 |
| CN | 20121138040 | A | 12/2012 |
| DE | 8113030 | | 8/1981 |
| DE | 9000453 | U1 | 3/1990 |
| DE | 4341539 | A1 | 6/1995 |
| DE | 19642119 | | 3/1998 |
| EP | 0989071 | A1 | 3/2000 |
| EP | 2418391 | | 2/2012 |
| EP | 2520504 | | 11/2012 |
| IE | 19642119 | A1 | 3/1998 |
| KR | 10-2012-012517 | A | 11/2012 |
| RU | 2283810 | C2 | 9/2006 |
| WO | WO2012085939 | | 6/2012 |

* cited by examiner

STATE OF THE ART

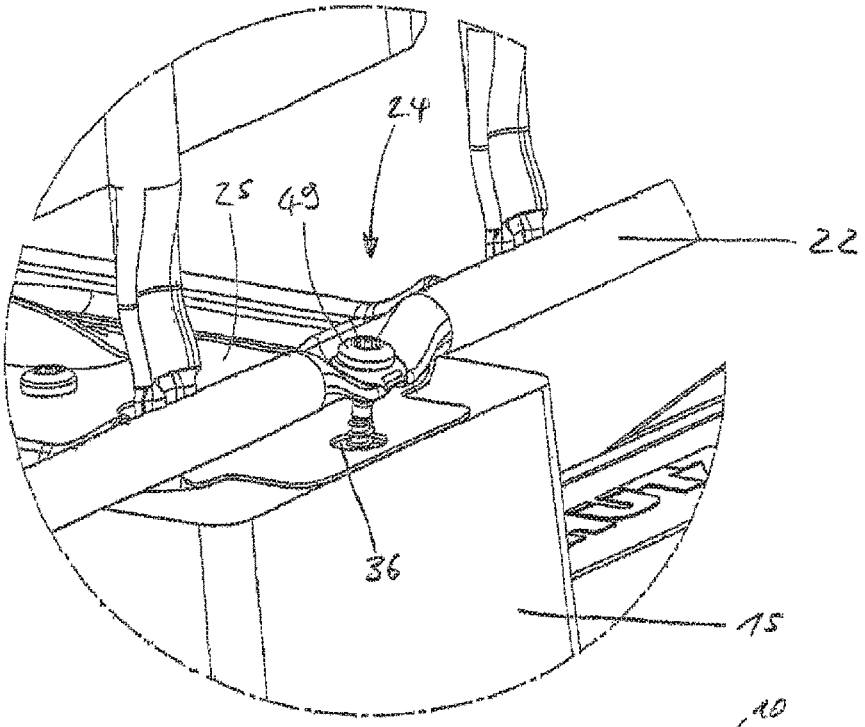
Fig. 2 STATE OF THE ART
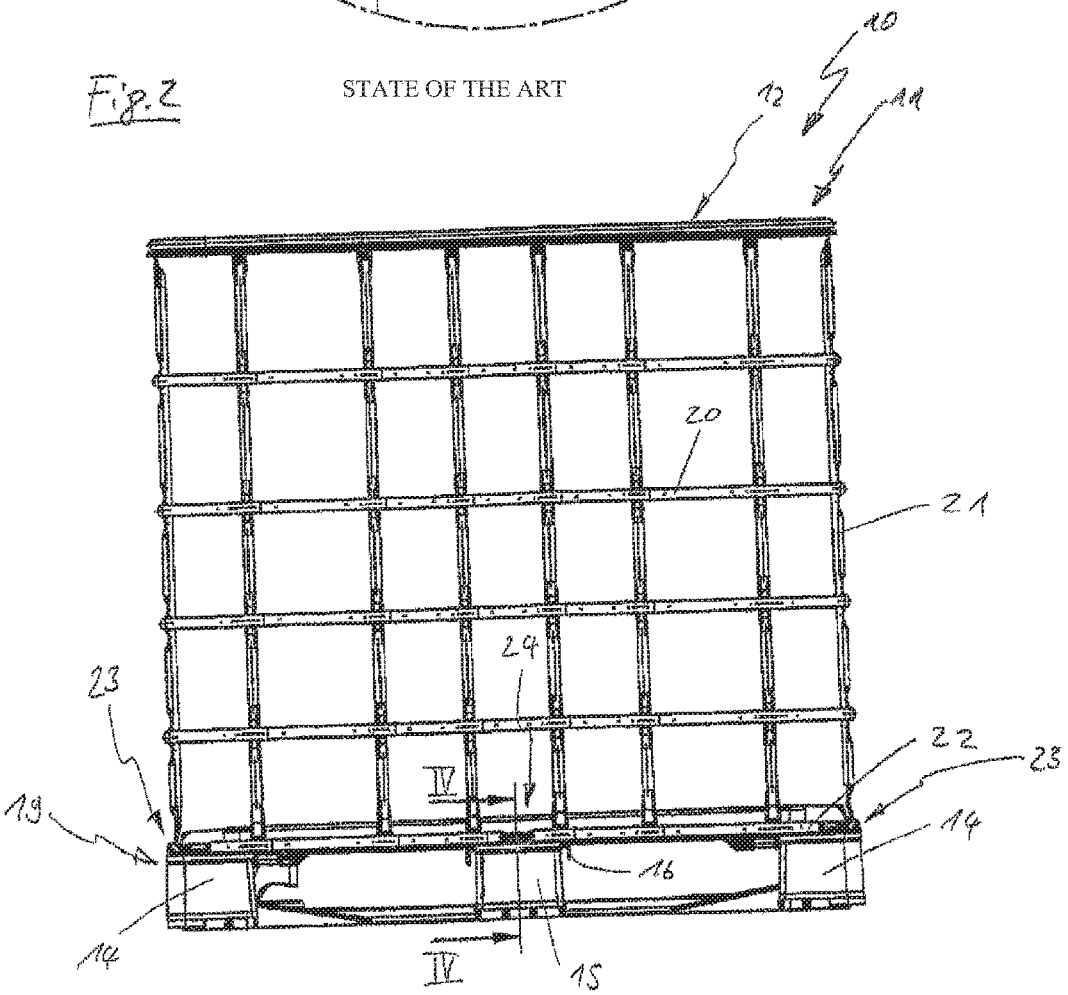
Fig. 3 STATE OF THE ART

STATE OF THE ART

PALLET-LIKE UNDERSTRUCTURE FOR TRANSPORT AND STORAGE CONTAINERS FOR LIQUIDS

FIELD OF THE INVENTION

The invention relates to a pallet-like understructure, in particular for transport and storage containers for liquids, which are equipped with an inner container made of plastic, with a closable filling neck and a draining neck for connecting a tapping armature, wherein the understructure has an outer jacket made of a metal grid or sheet metal, and a bottom for supporting the inner container, corner feet and central feet arranged between the corner feet as well as a bottom cross member, wherein at least the outer jacket and the bottom cross member are attached to at least two central feet, wherein the respective central foot, the outer jacket and the bottom cross member are coupled in a form-fitting fashion with the aid of a screw. In addition, the invention relates to a transport and storage container having such an understructure.

BACKGROUND OF THE INVENTION

Understructures of the afore-mentioned type form a platform that can be handled, for example, with the help of suitable stacker truck means, for storing and for transporting the inner containers realized from plastic. In this context, the outer jacket serves to protect inner container, which is comparatively fragile, from being damaged. The pallet-like understructure therefore is supposed to absorb, in particular, impact loads, which can act on the inner container, for example when the transport and storage container hits the floor. In particular when the transport and storage container strikes the floor or a ground at an angle, as a consequence of the mass inertia of a flowable substance present in the inner container, the inner container may be deformed or may also shift on the floor of the understructure. As a consequence, the outer jacket may be deformed in the region of the floor of the understructure in such a way that a protective sheath of the inner container formed by the outer jacket and by the floor of the understructure tears open in this region and that the inner container is damaged. Corresponding standardized drop tests are therefore envisaged for transport and storage containers envisaged for transporting hazardous materials, even though it is desirable to generally safeguard transport and storage containers from such damages.

SUMMARY OF THE INVENTION

In order to produce the understructures for transport and storage containers to be as stable as possible while the cost of materials is justifiable and the costs are low, it is known to screw the outer jacket directly to the feet while interleaving the bottom. In this context, the bottom and the feet of the understructure embody a pallet, wherein the feet may also be coupled to one another on a lower side by skids or by a frame. Since the bottom serves to support the inner container, a bottom cross member is habitually additionally disposed below the floor, said bottom cross member being arranged between two central feet and coupling the same to each other. The bottom cross member additionally serves to stabilize the understructure for the case of the transport and storage container hitting a ground along a along a foot frame side.

In the known transport and storage containers or understructures, the outer jacket or an underside of the outer jacket is coupled to the bottom, to the bottom cross member and to the central feet with the aid of screws. In order to design the understructure in a fashion as simple and cost-effective as possible, the screw is guided through sufficiently large clearance openings in the peripheral edge, in the bottom and in the bottom cross member and is only screwed into the central foot. When the transport and storage container hits the floor as described above along a foot frame side, as a consequence of a considerable tensile load on the screw, the screw may tear off or a screw thread of the screw may come off the central foot, whereupon the lower peripheral edge of the outer jacket is separated from the bottom of the understructure in such a fashion that the inner container may be deformed or damaged in this region. Here, a tensile force acting from the peripheral edge of the outer jacket on the screw directly acts on the coupling link of the screw and the central foot since the forces solely flow starting from the peripheral edge through the screw to the central foot. In particular when lightweight and cost-effective materials such as plastic or wood are supposed to be used for the central foot, screwing the screw and the central foot together has turned out to be a weak point in drop tests. Additionally, the screw may be positioned incorrectly upon mounting or may be "overtightened". Depending on the storage location, high temperatures may also weaken a screw coupling including, for example, plastic.

It is essential in such an attachment configuration that, for facilitating a relative positioning of the component parts upon mounting, sufficiently large clearance openings are disposed in the peripheral edge, in the bottom and in the bottom cross member, such that the same can easily be aligned with one another and that the screw can easily be introduced through the clearance opening and be screwed to the central foot. In particular, it is also advantageous if the clearance openings are dimensioned such amply that a comparatively large play is realized between the component parts mentioned above and the screw.

The present invention is therefore based on the task of proposing a pallet-like understructure for a transport and storage container for liquids as well as a transport and storage container having an understructure, guaranteeing an increased safety and still being producible in a simple and cost-effective fashion.

To solve this task, the understructure in accordance with the invention has the features of claim 1 and the transport and storage container in accordance with the invention has the features of claim 17.

In the understructure in accordance with the invention, in particular for transport and storage containers for liquids, which are equipped with an inner container made of plastic, with a closable filling neck and a draining neck for connecting a tapping armature, the understructure has an outer jacket made of a metal grid or sheet metal, and a bottom for supporting the inner container, corner feet and central feet arranged between the corner feet as well as a bottom cross member, wherein at least the outer jacket and the bottom cross member are attached to at least two central feet, wherein at least the respective central foot, the outer jacket and the bottom cross member are coupled together in a form-fitting fashion in an attachment configuration with the aid of a screw, wherein there is a bracket, which reaches around the bottom cross member and around a peripheral edge of the outer jacket, wherein the screw penetrates legs of the bracket.

The form-fitting coupling is established in particular in that the screw engages with a screw thread in the bottom cross member with a bolt thread. In this way, the screw is engaged with the bottom cross member in such a manner that a tensile force acting between the bottom cross member and the outer jacket can be transmitted via the screw. Therefore, the screw is coupled to the bottom cross member in such a fixed manner that a flow of forces, as a consequence of a tensile force acting on the outer jacket, may be transmitted into the screw from the outer jacket and be transferred to the bottom cross member through the screw. The screw is thus directly fixedly coupled to the bottom cross member. In addition, the screw is fixedly coupled to the respective central foot, such that a tensile force effected by the outer jacket, for example as a consequence of a crash of the transport and storage container, within the screw can be transferred into the bottom cross member and the central foot. A screw coupling of the screw and of the central foot is stressed less in this way, which leads to an increased stability or safety of the understructure, without further component parts being required. There is no risk of corrosion when screwing the screw and the bottom cross member together since the screw is fixedly coupled or screwed to the bottom cross member, such that an anti-corrosion coating of a surface cannot be destroyed and there cannot be any abrasion due to a relative movement of the structural elements.

In a preferred embodiment, the central foot, the outer jacket, the bottom and the bottom cross member may be coupled in a form-fitting fashion with the aid of the screw. The attachment configuration realized in this way then also comprises the bottom of the understructure, which does not necessarily have to be coupled to the same in the region of the central feet.

In addition, the screw may then reach through clearance openings embodied in each instance in the outer jacket and in the bottom. The clearance openings may preferably be embodied such that a sufficiently large play remains between inner rims of the clearance openings and the screw. The clearance openings in the outer jacket may then be embodied in a peripheral edge of the outer jacket. If the outer jacket is for example realized from interlaced, horizontal and vertical grid bars made of metal, the clearance openings may in each instance be embodied in a lower horizontal pipe, which then realizes the peripheral edge.

Alternatively, a screw thread may also be embodied in the bottom, the screw engaging with said screw thread. Accordingly, the screw would not only be coupled to the central foot and to the bottom cross member with the aid of a screw coupling, but also to the bottom of the understructure. Tensile forces realized in the screw can then also be transmitted into the bottom.

The bottom cross member may preferably be realized from metal, wherein the bottom may be realized from metal or from plastic material. It may also be envisaged to realize the bottom cross member in one piece, for example as a profiled element or as a structural element produced by forming metal sheets. The bottom may likewise be produced in a particularly cost-effective and stable fashion from a deep-drawn metal sheet or alternatively from a plastic material.

The screw coupling of the screw and the bottom cross member can particularly simply be realized if a clearance opening for engaging with the screw is embodied in the bottom cross member. In this way, it can then also be ensured that the screw, upon mounting of the understructure, is always screwed into the bottom cross member at the place envisaged therefor at said bottom cross member. The clearance opening may be embodied as a round borehole or as an elongated hole. In particular when the bottom cross member does not have any clearance opening for the screw, an increased expenditure of energy for screwing in the screw into the material of the bottom cross member is required. It is also of little importance when realizing a clearance opening how thick the material of the bottom cross member is. In this way, the bottom cross member may then be realized to be particularly stable.

In addition, an inside diameter of the clearance opening may be smaller than an outside diameter of the screw. In this way, it can then also be ensured that a screw thread of the screw actually comes into engagement with the material of the bottom cross member in the region of the clearance opening.

Advantageously, the clearance opening may be embodied with a hollow. A hollow, or cavity or bead allows for easier introduction of the screw into the clearance opening in such a manner that the screw is guided towards the clearance opening. In addition, the region of the clearance opening or screwed joint is stabilized through the hollow, such that it is made difficult that the screw comes off the bottom cross member. The hollow may also be implemented such that an inner rim of the clearance opening in the bottom cross member realizes a single turn or is brought into line with a lead of the screw. The hollow may be embodied to have an opening angle of 90°. Additionally, the hollow may be implemented so as to be round or oval or to have an elongated hole.

Consequently, a screw thread or internal screw thread may be embodied in the bottom cross member, the screw engaging said screw thread. In this context, a screw thread may already be realized in a clearance opening, into which screw thread the screw is simply screwed in.

The screw thread may also be embodied with the aid of the screw. In this context, the screw thread may be cut or molded into the bottom cross member with the aid the screw. The screw may then be a self-cutting screw or also a thread-forming screw. A so-called tapping screw or also a so-called screw nail may also be used for realizing the screw thread and for coupling to the bottom cross member and to the central foot.

Accordingly, the screw may be engaged with the central foot in a form-fitting fashion, in such a manner that a tensile force realized between the central foot and the outer jacket can be transmitted via the screw. The tensile force can thus, as already stated previously, not be completely transmitted by the screw alone into the central foot, but be received by the bottom cross member for a considerable part. The screw having been screwed into the central foot or the screw coupling realized in this way is then also stressed less, such that, in particular in the context of central feet made of plastic material or wood, it can be avoided that the screw comes off the central foot.

In order to realize the understructure to be even safer and more stable, the bottom cross member may be coupled to the central foot in a form-fitting fashion with the help of a further screw. The tensile force transmitted into the bottom cross member may then be transmitted onto the central foot via the screw. Realizing this further attachment configuration consisting of the bottom cross member, the further screw and the central foot may advantageously prevent the central foot from being torn off the bottom cross member as a consequence of a crash of the transport and storage container. In this way, any transverse forces acting on the central foot may also transmitted into the bottom cross member via the further screw.

It has turned out to be particularly advantageous if the central feet are realized from a plastic material. Such central feet are particularly stable, immune to humidity and can be produced in a cost-effective fashion. Alternatively, the central feet may also be realized from metal, wood or another suitable material.

A screw thread may be embodied in the central foot, with which the screw engages. In this context, an internal screw thread in the central foot can be cut or molded by the screw itself. The central foot may also be embodied such that it already has a screw thread. Preferably, a molding, for example a depression or a borehole, may be embodied in the central foot in order to guarantee a secure guiding and positioning of the screw upon mounting.

The understructure may have two central feet facing each other, which are coupled to each other via the bottom cross member. In this way, the bottom of the understructure may be supported or stabilized particularly simply with the aid of the bottom cross member. The bottom cross member may also couple three central feet to one another, wherein the third central foot can then be attached to the bottom cross member in the middle between the two outer central feet. Alternatively, it is also possible to couple, with the aid of the bottom cross member, two central feet arranged at orthogonal lateral rims of the bottom relative to each other in relation to the bottom, such that the bottom cross member runs diagonally below the bottom.

Complementarily, there may be a bracket, which reaches around the bottom cross member, around the bottom and around a peripheral edge of the outer jacket, wherein the screw may then penetrate the legs of the bracket. The bracket can then be screwed to the peripheral edge, to the bottom, to the bottom cross member and to the central foot, whereby a tensile force acting on the screw may at least partially be transferred to the bracket.

In the transport and storage container for liquids in accordance with the invention, which is equipped with an inner container made of plastic, with a closable filling neck and a draining neck for connecting a tapping armature, the inner container is arranged on a bottom of a pallet-like understructure according to one or more of the claims 1 to 16.

BRIEF DESCRIPTION OF THE DRAWING FIGURES

A preferred embodiment will be explained in more detail below using the drawings. In the figures:

FIG. 2 shows a detailed view of a central foot of the understructure from FIG. 1;

FIG. 3 shows a side view of the understructure according to the state of the art from FIG. 1;

DETAILED DESCRIPTION OF THE INVENTION

Figure 1:
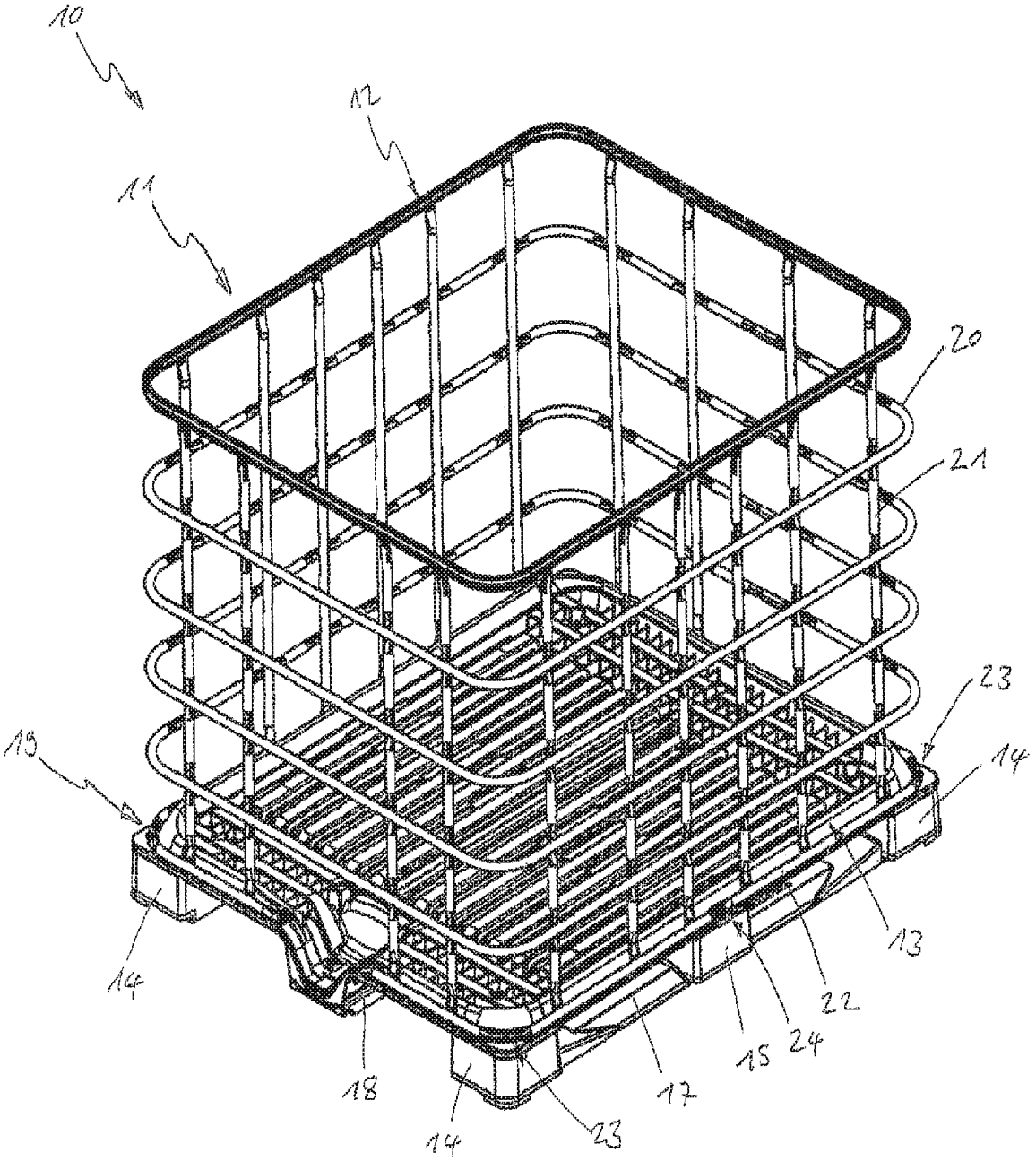
FIG. 1 shows a pallet-like understructure according to the state of the art in a perspective view.

FIGS. 1 to 4 show a transport and storage container 10 in different views, wherein in particular an inner container of the transport and storage container 10 is not depicted in more detail here, such that only an understructure 11 of the transport and storage container 10 is illustrated. The understructure 11 is substantially realized from an outer jacket 12, a bottom 13 as well as corner feet 14 and central feet 15 arranged between the corner feet 14 and from a bottom cross member 16 situated between the central feet 15. In detail, the corner feet 14 and the central feet 15 are arranged on skids 17 or 18. The bottom 13, the corner feet 14, the central feet 15, the bottom cross member 16 as well as the skids 17, 18 together realize a pallet 19. The outer jacket 12 arranged on the pallet 19 is realized from interlaced, horizontal and vertical grid bars 20, 21 made of metal, wherein in particular a lower grid bar 20 resting on the pallet 19, of the outer jacket 12, is embodied as a pipe 22, which is coupled to the corner feet 14 via attachment points 23 and to the central feet 15 via attachment points 24.

Figure 4:
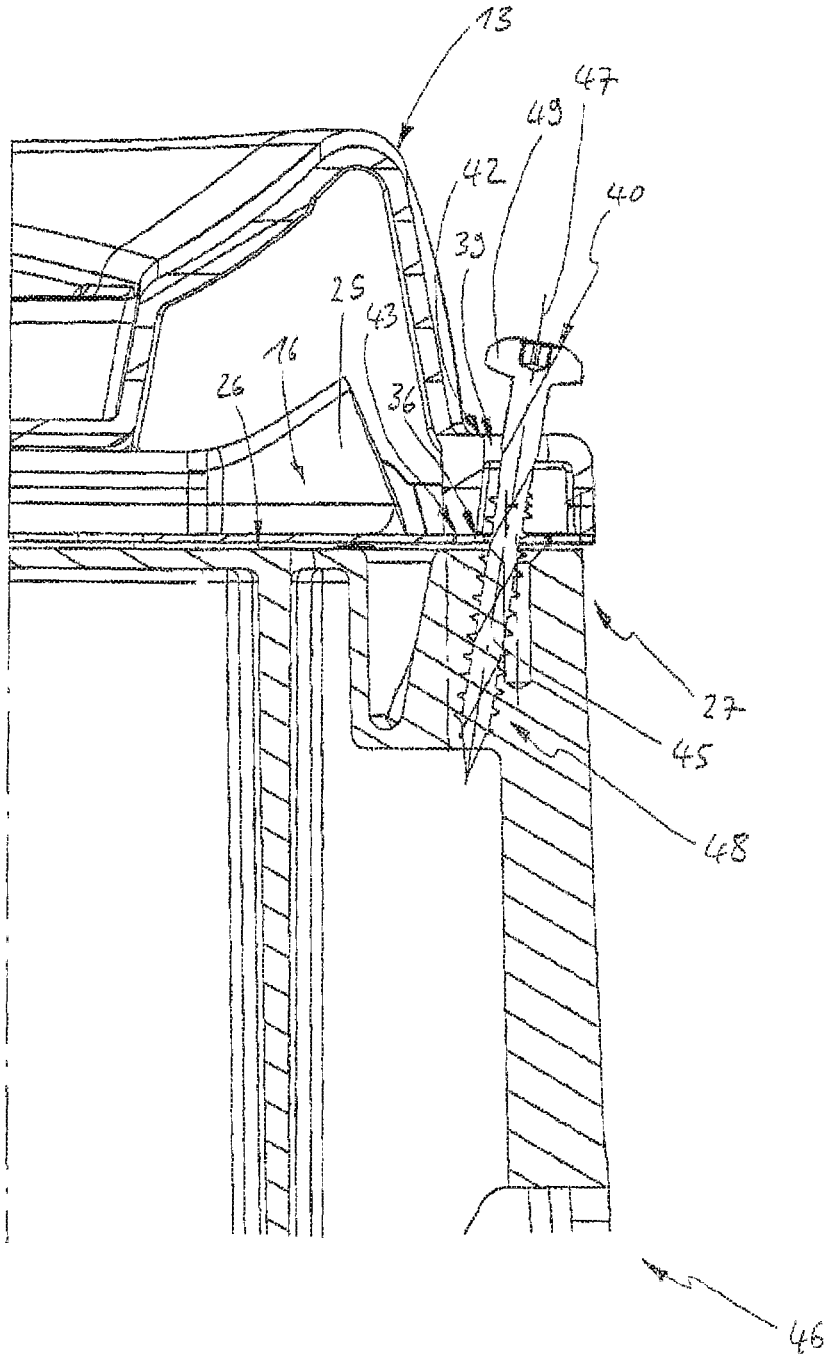
FIG. 4 shows a sectional view along a line IV-IV from FIG. 3.

A combined view of FIGS. 2 and 4 shows an attachment point 24 with a central foot 15, wherein the bottom 13 is not illustrated in the view illustrated in FIG. 2. The bottom cross member 16 is formed from a profiled body 25 made of metal, and is arranged on an upper side 26 of the central foot 15. In addition, the bottom 13 has been placed onto the bottom cross member 16 or on the profiled body 25 above the bottom cross member 16 in an edge region 27 of the central foot 15. In addition, a clearance opening 39 is likewise disposed in the bottom 13, wherein a screw 40 has been screwed into the central foot 15 through the clearance opening 39 and through a clearance opening 36 of the profiled body 25. In this context, the inside diameters 42 and 43 of the clearance opening 36 or 39 are dimensioned to be so large that a sufficiently large play relative to a shank 45 of the screw 40 is realized, which prevents a touch with the screw 40 in the region of the inside diameters 42 and 43. The same is true for the clearance opening 36 not illustrated in a detailed fashion here, in the profiled body 25.

An impact force now effected as a consequence of a crash of the transport and storage container 10 onto an outer rim 46 of the central foot 15 again leads to a deformation or shift of the inner container not illustrated here within the outer jacket 12, such that the outer jacket 12 for its part exerts a tensile force in the direction of a longitudinal axis 47 of the screw 40 onto the same. In this context, the tensile force directly acts on a screw coupling 48 of the screw 40 with the central foot 15.

Figure 5:
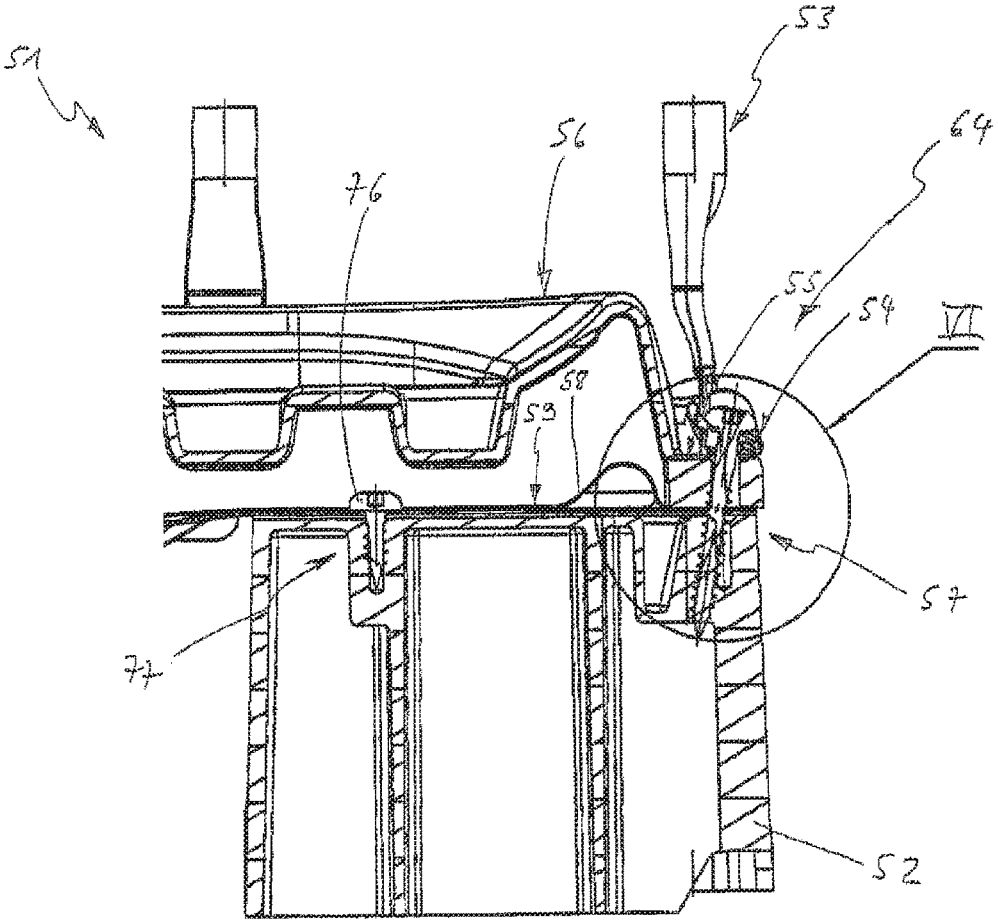
FIG. 5 shows a sectional view in the region of a central foot of an understructure.
Figure 6:
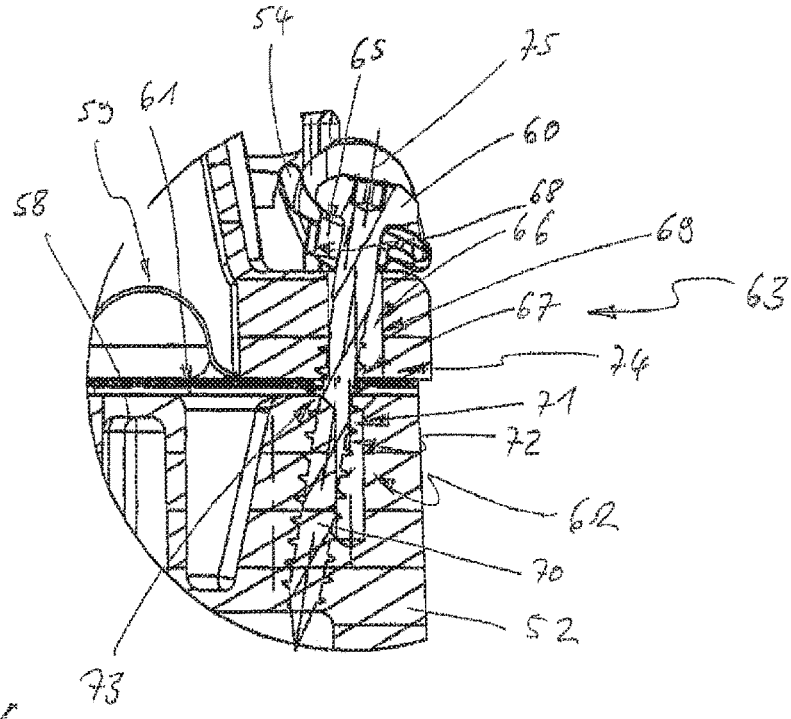
FIG. 6 shows a detailed view of the sectional view from FIG. 5.

A combined view of FIGS. 5 and 6 shows a sectional view of an understructure 51 of a transport and storage container not illustrated in more detail here, in the region of a central foot 52. The fundamental construction of the transport and storage container and of the understructure 51 corresponds to the transport and storage container shown in FIGS. 1 to 4, apart from the differences described below. An outer jacket 53 of the understructure 51 rests on a circumferential bearing face 55 of a bottom 56 of the understructure 51 with a pipe 54. The bottom 56 for its part rests on an edge region 57 of the central foot 52 together with a one-piece profiled body 58, which embodies a bottom cross member 59. The bottom cross member 59 or the profiled body 58 couples the central foot 52 to an opposing central foot not illustrated in more detail here. In addition, a screw 60 is envisaged, which has been screwed into an upper side 61 of the central foot 52 made of plastic material, in this way realizing a screw coupling 62. The screw 60 thus couples the outer jacket 53 to the bottom 56, the profiled body 58 or to the bottom cross member 59 and the central foot via pipe 54, whereby an attachment configuration 63 is realized in an attachment point 64 at the central foot 52.

From the enlarged illustration of FIG. 6, it can be seen that the screw 60 has been guided through a clearance opening 65 in the pipe 54, through a clearance opening 66 in the bottom 56, and through a clearance opening 67 in the profiled body 58. In particular, an inside diameter 68 of the clearance opening 65 and an inside diameter 69 of the clearance opening 66 is selected such that the screw 60 or a shank 70 of the screw 60 has been guided through the clearance openings 65 and 66, while a play is realized. An inside diameter of the clearance opening 67 that cannot be seen anymore here is realized so as to be smaller than an outside diameter 71 of the screw 60, such that, upon screwing the screw 60 into the clearance opening 67, an internal screw thread 73 is realized in the clearance opening 67 with the aid of an external screw thread 72 of the screw 60, and thus a screw coupling 74 is realized between the bottom cross member 59 and the screw 60. A tensile force effected by the loading case described above, of a crash of the transport and storage container, acting in the direction of a longitudinal axis 75 of the screw 60, is consequently transmitted into the central foot 53 via the screw 60 in this way, wherein a part of the tensile force is equally transmitted into the profiled body 58 or the bottom cross member 59, as a consequence of the screw coupling 74 being realized. The screw coupling 62 with the central foot 52 is relieved by the amount of this part of the tensile force without the bracket known from the state of the art having to be used.

Complementarily, a second screw 76 is envisaged, with the aid of which the profiled body 58 is coupled to the central foot 52 by screwing them together. The screw 76, the profiled body 58 and the central foot 52 thus realize a further attachment configuration 77, which serves to safely arrange the central foot 52 at the profiled body 58.

Figure 7:
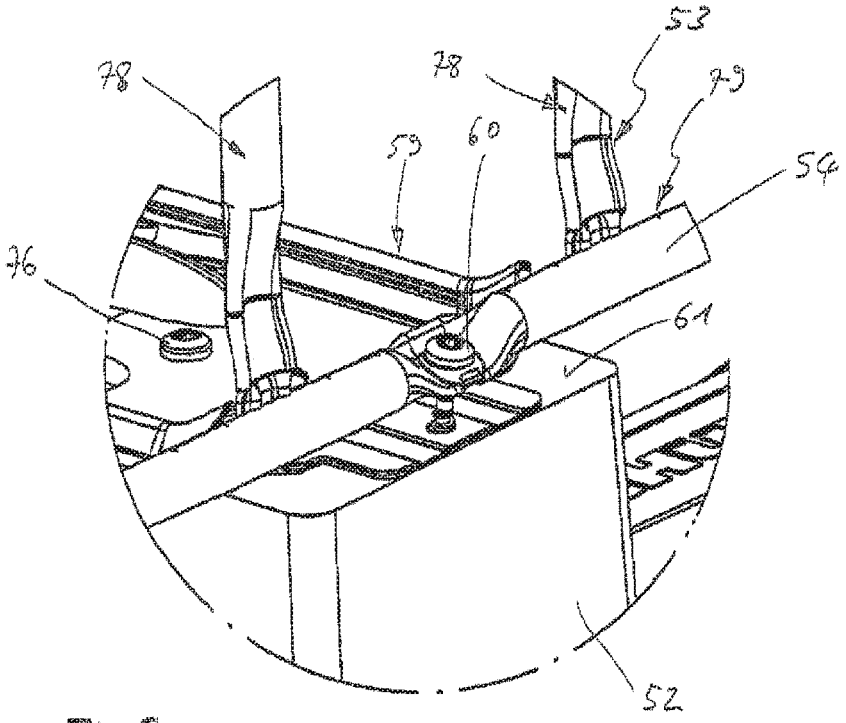
FIG. 7 shows a perspective detailed view of the central foot of the understructure from FIG. 5.

FIG. 7 shows a perspective view of the understructure 51 without illustration of the bottom. In particular, it can be seen that the outer jacket 53 is realized from vertical grid bars 78 and horizontal grid bars 79, wherein a lower grid bar 79 of the outer jacket 53 realizes the pipe 54.

Figure 8:
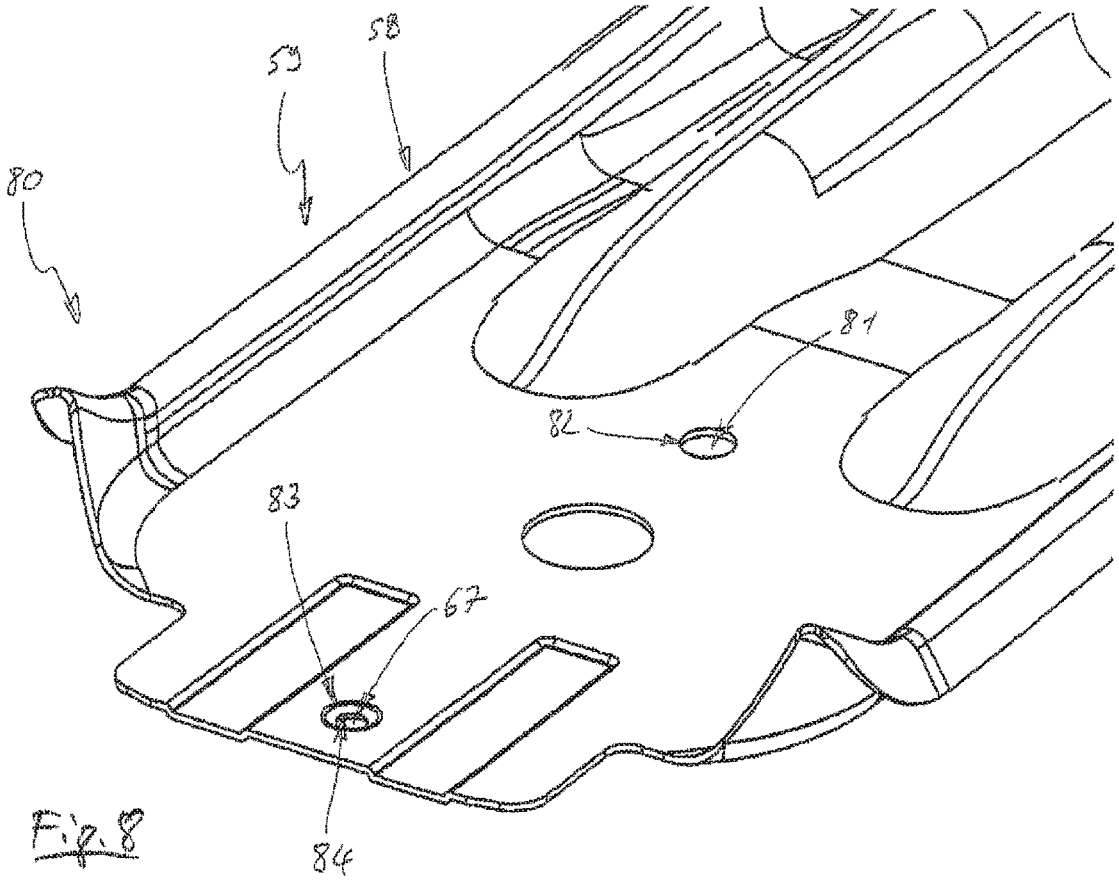
FIG. 8 shows a perspective view of a bottom cross member of the understructure from FIG. 5.

FIG. 8 shows an end 80 of the bottom cross member 59, which rests on the upper side 61 of the central foot 52. The bottom cross member 59 or the profiled body 58 is realized from a formed metal sheet and in particular has a clearance opening 81 for the screw 76. In this context, an inside diameter 82 of the clearance opening 81 is realized such that the screw 76 can easily be pushed or screwed through the clearance opening 81. The clearance opening 67, in the illustration shown here, does not have any internal screw thread yet, since the screw 60 has not been screwed in and consequently a screw thread has not been realized yet. In addition, a hollow 83 is realized in the region of the clearance opening 67. The hollow 83 serves to stiffen the screw joint realized at a later point and for guiding the screw upon mounting. An inside diameter 84 of the clearance opening 67 is in particular embodied so as to be smaller than the external screw thread 72 of the screw 60.

The invention claimed is:

1. A pallet understructure (51) for transport and storage containers for liquids, which are equipped with an inner container made of plastic, with a closable filling neck and a draining neck for connecting a tapping armature, wherein the understructure has an outer jacket (53) made of a metal grid or sheet metal, and a bottom (56) for supporting the inner container, corner feet and at least two central feet (52) arranged between the corner feet as well as a bottom cross member (59), wherein at least the outer jacket and the bottom cross member are attached to at least two central feet, wherein the respective central feet (52), the outer jacket and the bottom cross member are coupled in a form-fitting fashion with the aid of a screw (60), characterized in that a clearance opening (67) for engaging with the screw (60) is embodied in the bottom cross member (59), an inside diameter (84) of the clearance opening (67) is smaller than an outside diameter (71) of the screw (60) in such a manner that a tensile force acting between the bottom cross member (59) and the outer jacket (53) can be transmitted via the screw (60), the screw (60) reaches through clearance openings (65, 66) embodied in each instance in the outer jacket (53) and in the bottom (56), such that the screw (60) is engaged with the bottom cross member (59) in a form-fitting fashion.

2. The understructure according to claim 1, characterized in that the central foot (52), the outer jacket (53), the bottom (56) and the bottom cross member (59) are coupled in a form-fitting fashion with the aid of the screw (60).

3. The understructure according to claim 2, characterized in that a screw thread is embodied in the bottom (56), the screw (60) engaging with said screw thread.

4. The understructure according to claim 1, characterized in that the bottom cross member (59) is realized from metal, and in that the bottom (56) is realized from metal or from plastic material.

5. The understructure according to claim 1, characterized in that the clearance opening (67) is embodied with a hollow (83).

6. The understructure according to claim 1, characterized in that a screw thread (73) is embodied in the bottom cross member (59), the screw (60) engaging said screw thread.

7. The understructure according to claim 6, characterized in that the screw thread (73) is embodied with the aid of the screw (60).

8. The understructure according claim 1, characterized in that the screw (60) is engaged with the central foot (52) in a form-fitting fashion, in such a manner that a tensile force realized between the central foot and the outer jacket (53) can be transmitted via the screw.

9. The understructure according to claim 1, characterized in that the bottom cross member (59) is coupled to the central foot (52) in a form-fitting fashion with the aid of a further screw (60).

10. The understructure according to claim 1, characterized in that the central feet (52) are realized from a plastic material.

11. The understructure according claim 1, characterized in that a screw thread is embodied in the central foot (52), with which the screw (60) engages.

12. The understructure according to claim 1, characterized in that two central feet (52) facing each other are coupled to each other via the bottom cross member (59).

13. The understructure according to claim 1 characterized in that there is a bracket, which reaches around the bottom cross member (59), around the bottom (56) and around a peripheral edge of the outer jacket (53), wherein the screw (60) penetrates legs of the bracket.

14. A transport and storage container for liquids, which is equipped with an inner container made of plastic, with a closable filling neck and a draining neck for connecting a tapping armature, wherein the inner container is arranged on a bottom of a pallet understructure (51) according to claim 1.

* * * * *